US007198712B2

(12) United States Patent
Olivier-Bourbigou et al.

(10) Patent No.: US 7,198,712 B2
(45) Date of Patent: Apr. 3, 2007

(54) PROCESSING FOR ELIMINATING SULFUR-CONTAINING COMPOUNDS AND NITROGEN-CONTAINING COMPOUNDS FROM HYDROCARBON

(75) Inventors: Helene Olivier-Bourbigou, Rueil Malmaison (FR); Denis Uzio, Marly le Roi (FR); Lionel Magna, Rueil Malmaison (FR); Fabrice Diehl, Rueil Malmaison (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 550 days.

(21) Appl. No.: 10/462,809

(22) Filed: Jun. 17, 2003

(65) Prior Publication Data

US 2004/0045874 A1 Mar. 11, 2004

(30) Foreign Application Priority Data

Jun. 17, 2002 (FR) ..... 02 07453

(51) Int. Cl.

| | |
|---|---|
| ***B01J 21/08*** | (2006.01) |
| ***B01J 21/12*** | (2006.01) |
| ***B01J 21/14*** | (2006.01) |
| ***C10G 29/20*** | (2006.01) |

(52) U.S. Cl. ..... 208/238; 208/89; 205/696; 252/62; 361/504; 429/188; 429/199; 502/237; 568/16

(58) Field of Classification Search ..... 205/696; 208/89, 238; 252/62; 361/504; 429/188, 429/199; 502/237; 568/16

See application file for complete search history.

(56) References Cited

U.S. PATENT DOCUMENTS

| | | | | |
|---|---|---|---|---|
| 2,343,794 | A | 3/1944 | Paulsen | |
| 4,206,036 | A * | 6/1980 | Takeuchi et al. | 208/89 |
| 6,274,026 | B1 * | 8/2001 | Schucker et al. | 205/696 |
| 2002/0015884 | A1 * | 2/2002 | Schmidt et al. | 429/188 |

FOREIGN PATENT DOCUMENTS

| | | |
|---|---|---|
| GB | 499978 | 2/1939 |
| NL | 8104616 | 5/1983 |
| WO | WO 0234863 | 5/2002 |

OTHER PUBLICATIONS

Boesmann, A. et al, Deep Desulfurization of diesel fuel by extraction with ionic liquids, Chem. Commun., 2001, 2494-2495.*

Y. Shiraishi "A Novel Desulfurization Process for Fuel Oils Based On the Formation and Subsequent Precipitation of S-Alkylsulfonium Salts" Industrial & Engineering Chemistry Research, vol. 40, No. 22, 2001, pp. 4919-4924.

* cited by examiner

*Primary Examiner*—Glenn Caldarola
*Assistant Examiner*—Prem C. Singh
(74) *Attorney, Agent, or Firm*—Millen, White, Zelano & Branigan, P.C.

(57) ABSTRACT

For desulfurization and, if necessary, for denitrification of hydrocarbon fractions the hydrocarbon mixture is brought into contact with a non-aqueous ionic liquid of general formula $Q^+A^-$, wherein $Q^+$ is a ammonium, phosphonium or sulfonium cation, that contains at least one alkylating agent of the formula $RX^-$, making it possible to form ionic sulfur-containing derivatives (and, if necessary, nitrogen-containing derivatives) that have a preferred solubility in the ionic liquid; and the ionic liquid is separated from the hydrocarbon mixture that is low in sulfur and nitrogen by decanting.

22 Claims, No Drawings

PROCESSING FOR ELIMINATING SULFUR-CONTAINING COMPOUNDS AND NITROGEN-CONTAINING COMPOUNDS FROM HYDROCARBON

This invention relates to the field of desulfurization and denitrification of hydrocarbon fractions.

It has as its object a process for desulfurization and, if necessary, for denitrification of hydrocarbon fractions and a catalyst for this process.

DESULFURIZATION PROBLEMS OF FCC GASOLINES

The production of reformulated gasolines that correspond to new environmental standards requires in particular that their olefin concentration be reduced slightly to keep a high octane number but that their sulfur content be reduced significantly. Thus, the current and future environmental standards make it necessary for the refiners to lower the sulfur content in gasolines to values that are lower than or at most equal to 50 ppm in 2003 and 10 ppm beyond 2005. These standards relate to the total sulfur content but also the nature of the sulfur-containing compounds such as the mercaptans.

The feedstock that is to be hydrotreated is generally a gasoline fraction that contains sulfur, such as, for example, a fraction that is obtained from a coking unit, a visbreaking unit, a steam-cracking unit or a catalytic cracking unit (FCC). Said feedstock preferably consists of a gasoline fraction that is obtained from a catalytic cracking unit whose range of boiling points typically extends from hydrocarbons with 5 carbon atoms up to about 250° C. This gasoline optionally can consist of a significant gasoline fraction that is obtained from other production processes such as atmospheric distillation ("straight run" gasoline) or conversion processes (coking gasoline or steam-cracking gasoline).

The catalytic cracking gasolines, which can represent 30 to 50% of the gasoline pool, have high olefin and sulfur contents. The sulfur that is present in the reformulated gasolines can be nearly 90% attributed to the catalytic cracking gasoline. The desulfurization (hydrodesulfurization) of the gasolines and primarily the FCC gasolines is therefore of obvious importance for achieving the specifications. Hydrotreatment (or hydrodesulfurization) of the catalytic cracking gasolines, when it is carried out under standard conditions known to one skilled in the art, makes it possible to reduce the sulfur content of the fraction. This process, however, exhibits the major drawback of bringing about a very significant drop in the octane number of the fraction, due to the saturation of all of the olefins during hydrotreatment.

The gasoline fractions and more particularly the gasolines that are obtained from the FCC contain about 20 to 40% of olefinic compounds, 30 to 60% of aromatic compounds and 20 to 50% of saturated paraffin-type or naphthene-type compounds. Among the olefinic compounds, the branched olefins predominate relative to the linear and cyclic olefins. These gasolines also contain traces of highly unsaturated compounds of diolefinic type that are able to deactivate the catalysts by gum formation. The content of sulfur-containing compounds of these gasolines is very variable based on the type of gasoline (steam-cracking device, FCC, coker . . . ) or, in the case of the FCC, the degree of severity applied to the process. It can fluctuate between 200 and 5000 ppm of S, preferably between 500 and 2000 ppm relative to the feedstock weight. The families of thiophenic compounds and benzothiophenic compounds are in the majority, while the mercaptans are present only at lower levels, generally between 10 and 100 ppm. The FCC gasolines also contain nitrogen-containing compounds in proportions that generally do not exceed 100 ppm.

The sulfur-containing compounds that are generally found in the gasolines are thus as follows:

- the mercaptans: all of the mercaptans of general formula $R_1SH$, whereby $R_1$ is an alkyl, aryl or alkaryl radical that comprises up to 10 carbon atoms; there will be cited, for example, methyl mercaptan $CH_3SH$, ethyl mercaptan $CH_3CH_2SH$, propyl mercaptan $CH_3(CH_2)_2SH$ and butyl mercaptan $CH_3(CH_2)_3SH$;
- the sulfides and disulfides: all of the sulfides of formulas $R_1SR_2$ and disulfides of formulas $R_1SSR_2$ with $R_1$ and $R_2$ that are different or identical and that represent an alkyl, aryl or alkaryl radical of 1 to 10 carbon atoms. For example, the dimethyl sulfide $CH_3SCH_3$, ethyl methyl sulfide $CH_3CH_2SCH_3$ or methyl ethyl disulfide $CH_3SSCH_2CH_3$;
- the thiophanes: for example, tetrahydrothiophane and methyl tetrahydrothiophane;
- the thiophenes: for example, thiophene, methyl thiophenes, ethyl thiophenes, etc.,
- the benzothiophenes: for example, benzothiophene and methyl benzothiophenes.

SOME PROPOSED PROCESSES FOR FCC GASOLINES

Various types of processes that make it possible to desulfurize the FCC gasolines deeply while keeping the octane number at a high level have therefore been proposed. Patent U.S. Pat. No. 5,318,690 thus proposes a process that consists in fractionating the gasoline, in sweetening the light fraction and in hydrotreating the heavy fraction on a conventional catalyst then in treating it on a ZSM5 zeolite to restore the initial octane. Patent Application WO-A-01/40 409 claims the treatment of an FCC gasoline under conditions of high temperature, low pressure and high hydrogen/feedstock ratio. Under these particular conditions, the recombination reactions that result in the formation of mercaptans, involving the $H_2S$ that is formed by the desulfurization reaction, and the olefins are reduced. Finally, Patent U.S. Pat. No. 5,968,346 proposes a diagram that makes it possible to reach very low residual sulfur contents by a process in several stages: hydrodesulfurization in a first catalyst, separation of liquid and gaseous fractions, and a second hydrotreatment on a second catalyst. The liquid/gas separation makes it possible to eliminate the $H_2S$ that is formed in the first reactor, $H_2S$ being incompatible with obtaining a good hydrodesulfurization/octane loss compromise. Finally, other alternatives have also been proposed, based on adsorption processes (WO-A-01/14 052) or biodesulfurization processes.

Obtaining the desired reaction selectivity (hydrodesulfurization/hydrogenation) can therefore be due to the selection of the process but in all cases the use of an inherently selective catalytic system is a key factor.

In a general way, the catalysts that are used for this type of application are sulfide-type catalysts that contain an element of group VIB (Cr, Mo, W) and an element of group VIII (Fe, Ru, Os, Co, Rh, Ir, Pd, Ni, Pt). Thus, in Patent U.S. Pat. No. 5,985,136, it was found that a catalyst that has a surface area concentration of between 0.5 and 3E-04 g of $MoO^3/m^2$ made it possible to reach high selectivities (hydrodesulfurization (HDS)=93% against Hydrogenation Des Olefines [hydrogenation of olefins] (HDO)=33%). Likewise, it may be advantageous to add a dopant (alkaline, alkaline-earth) to the conventional sulfide phase (CoMoS) to limit the hydrogenation of olefins (Patents U.S. Pat. No. 4,140,626 and U.S. Pat. No. 4,774,220). Another method making it possible to improve the inherent selectivity of catalysts is to take advantage of the presence of carbon-containing deposits on the surface of the catalyst (U.S. Pat. No. 4,149,965 or EP-A-0 745,660).

DESULFURIZATION PROBLEMS OF MIDDLE DISTILLATES (GAS OILS, KEROSENES)

The stepping-up of automobile pollution standards (and in particular those that relate to vehicles with diesel engines) for the year 2005 in the European Community (*Off. J. Eur. Comm.*, L350, Dec. 28, 1998, page 58) will make it necessary for the refiners to very greatly reduce the sulfur content in the gas oils (50 parts per million (ppm) by weight of maximum sulfur in the gas oils on Jan. 1, 2005 against 350 ppm on Jan. 1, 2000). In some countries such as Germany, there is already talk of producing gas oils with only 10 ppm by weight of sulfur in the very near future (2003) with particularly advantageous tax incentives for the refiners. In recent years, therefore, numerous scientific publications have naturally been seen that exhibit technical difficulties to be surmounted with catalytic purification processes (called hydrotreatment processes) that are currently used in the refining industry, to emphasize the limitations of these processes for the treatment of petroleum feedstocks in the year 2005 and in particular those that correspond to middle distillates.

Usually, a hydrotreatment catalyst of hydrocarbon fractions has as its object to eliminate the sulfur-containing or nitrogen-containing compounds that are contained in the latter to bring, for example, a petroleum product up to the required specifications (sulfur content, content of aromatic compounds, etc . . . ) for a given application (gas-oil fuel, domestic fuel, jet fuel). It can also involve pretreating this feedstock so as to eliminate impurities from it before subjecting it to different transformation processes to modify its physico-chemical properties (reforming, vacuum distillate hydrocracking, atmospheric or vacuum residue hydroconversion). Hydrotreatment catalysts and use thereof are particularly well described in the article by B. S. Clausen, H. T. Topsøe, and F. E. Massoth that is obtained from the work *Catalysis Science and Technology*, Volume 11 (1996), Springer-Verlag. Numerous works deal more specifically with the problems of deep hydrodesulfurization of gas oils (special edition of *Fuel Processing Technology*, Volume 61, (1999) or else also *Advances in Catalysis*, Volume 42 (1998), Academic Press. It appears that the final desulfurization of the gas oils makes it necessary to have to transform, in addition to the sulfur-containing compounds analogous to those contained in the gasolines, sulfur-containing molecules that are particularly refractory to standard hydrodesulfurization. These compounds consist of the family of alkyldibenzothiophenes and in particular the isomers that have a branch on 4- and 6- positions of the carbon-containing skeleton of the molecules. These compounds are particularly difficult to eliminate by a hydrotreatment catalyst, because the accessibility to the sulfur atom by the active radicals of the molybdenum sulfide-type catalysts is made extremely difficult. Furthermore, advanced mechanical studies have made it possible to demonstrate that the refractory nature in the desulfurization of these compounds was inherent to their structure: see the article by Vrinat et coll. in *Journal of Catalysis*, Volume 193, pages 255–263 (2000). The transformation of these compounds under conventional conditions of hydrotreatment processes (high pressure of hydrogen, high temperature) proceeds for the most part by hydrogenation prior to one of the two aromatic cycles. Due to their structure that carries a sulfur atom on both sides, this hydrogenation stage can be considered as a very slow stage in terms of kinetics. It is therefore difficult to eliminate these compounds totally by a catalytic process and under very advantageous conditions (in particular in terms of hourly volumetric flow rate).

The development of non-catalytic processes to carry out the final desulfurization of distillate-type petroleum feedstocks is in full swing. It is possible to cite the following applications that report on purification processes based on oxidation of sulfur-containing compounds (U.S. Pat. Nos. 5,910,440, U.S. Pat. No. 5,824,207, U.S. Pat. No. 5,753,102, U.S. Pat. No. 3,341,448 and U.S. Pat. No. 2,749,284) or else also based on adsorption (U.S. Pat. No. 5,730,860, U.S. Pat. No. 3,767,563, U.S. Pat. No. 4,830,733) or else based on complexing by use of feedstock transfer complexes WO-A-98/56 875.

A new process for desulfurization and denitrification of light gasoline that consists in alkylating the sulfur (or nitrogen) from molecules to be eliminated to form sulfoniums (or ammoniums) was also described (Y. Shiraishi et al. Ind. Eng. Chem. Res. 2001, 40, 4919). The advantage of this process is to use neither catalyst nor hydrogen and to be able to be operated under moderate conditions. However, it has the drawback of forming insoluble ionic compounds that must be separated, after anion metathetic exchange, by filtration.

The gasoline and gas-oil fractions can also contain nitrogen-containing compounds (pyridines, amines, pyrroles, anilines, quinoline, acridine, optionally substituted by alkyl, aryl or alkaryl groups) that can inhibit the desulfurization reactions. It is therefore advantageous to carry out a deep desulfurization also to eliminate nitrogen-containing compounds.

SUMMARY OF INVENTION

The non-aqueous ionic liquids of general formula $Q^+A^-$, initially developed by electrochemists, are now used increasingly as solvents and catalysts for organic, catalytic or enzymatic reactions, as solvents for liquid-liquid separations or else for the synthesis of new materials (H. Olivier-Bourbigou, L. Magna, J. Mol. Catal., 2002). Because of their completely ionic nature and their polar nature, these media prove to be very good solvents of ionic or polar compounds.

These media are also very good solvents for carrying out alkylation reactions and in particular, they are excellent solvents for carrying out the alkylation of sulfur-containing or nitrogen-containing derivatives respectively of sulfonium and ammonium. Accordingly, this invention provides a process for eliminating sulfur-containing compounds, and, if necessary, nitrogen-containing compounds from a mixture of hydrocarbons that contains them, whereby said process is characterized in that:

said hydrocarbon mixture is brought into contact with a non-aqueous ionic liquid of general formula $Q^+A^-$ that contains at least one alkylating agent, making it possible to form ionic sulfur-containing derivatives, and, if necessary, ionic nitrogen-containing derivatives that have a preferred solubility in said ionic liquid;

said ionic liquid is separated from the hydrocarbon mixture that is low in sulfur (and, if necessary, in nitrogen) any conventional method, for example, by decanting.

In the non-aqueous ionic liquid of formula $Q^+A^-$, the $A^-$ anions are preferably selected from among the halide anions, nitrate, sulfate, phosphate, acetate, haloacetates, tetrafluoroborate, tetrachloroborate, hexafluorophosphate, hexafluoroantimonate, fluorosulfonate, alkyl sulfonates (for example, methyl sulfonate), perfluoroalkyl sulfonates (for example, trifluoromethyl sulfonate), bis(perfluoroalkylsulfonyl) amides (for example bis-trifluoromethanesulfonyl amide of formula $N(CF_3SO_2)_2^-$), tris-trifluoromethanesulfononyl methylide of formula $C(CF_3SO_2)_3^-$, arenesulfonates, optionally substituted by halogen or haloalkyl groups, as well as the tetraphenylborate anion and the tetraphenylborate anions whose aromatic cores are substituted.

The $Q^+$ cations are preferably selected from the group of phosphonium, ammonium and/or sulfonium cations.

The quaternary ammonium and/or phosphonium $Q^+$ cations preferably correspond to one of general formulas $NR^1R^2R^3R^{4+}$ and $PR^1R^2R^3R^{4+}$ or to one of general formulas $R^1R^2N{=}CR^3R^{4+}$ and $R^1R^2P{=}CR^3R^{4+}$ in which $R^1$, $R^2$, $R^3$ and $R^4$, identical or different, each represent hydrogen (with the exception of the $NH_4^+$ cation for $NR^1R^2R^3R^{4+}$), preferably a single substituent that represents hydrogen, or hydrocarbyl radicals that have 1 to 30 carbon atoms, for example alkyl, alkenyl, cycloalkyl or aromatic groups, aryl or aralkyl groups, optionally substituted, comprising 1 to 30 carbon atoms.

The ammonium and/or phosphonium cations can also be derived from nitrogen-containing and/or phosphorus-containing heterocyclic compounds that comprise 1, 2 or 3 nitrogen and/or phosphorus atoms, of general formulas:

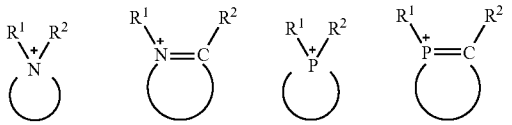

in which the cycles consist of 4 to 10 atoms, preferably 5 to 6 atoms, and $R^1$ and $R^2$ are defined as above.

The quaternary ammonium or phosphonium cation can also correspond to one of general formulas:

$R^1R^{2+}N{=}CR^3{-}R^5{-}R^3C{=}N^+R^1R^2$ and $R^1R^{2+}P{=}CR^3{-}R^5{-}R^3C{=}P^+R^1R^2$ in which $R^1$, $R^2$ and $R^3$, identical or different, are defined as above and $R^5$ represents an alkylene radical or a phenylene radical. Among the groups $R^1$, $R^2$, $R^3$ and $R^4$, the radicals methyl, ethyl, propyl, isopropyl, butyl, sec-butyl, tert-butyl, amyl, phenyl or benzyl will be mentioned; $R^5$ can be a methylene, ethylene, propylene or phenylene group.

The $Q^+$ ammonium and/or phosphonium cation is preferably selected from the group that is formed by N-butylpyridinium, N-ethylpyridinium, pyridinium, ethyl-3-methyl-1-imidazolium, butyl-3-methyl-1-imidazolium, hexyl-3-methyl-1-imidazolium, butyl-3-dimethyl-1,2-imidazolium, diethyl-pyrazolium, N-butyl-N-methylpyrrolidinium, trimethylphenyl-ammonium, tetrabutylphosphonium, and tributyl-tetradecyl-phosphonium.

The sulfonium cations according to the invention have as a general formula $SR^1R^2R^{3+}$, where $R^1$, $R^2$ and $R^3$, identical or different, each represent a hydrocarbyl radical that has 1 to 12 carbon atoms, for example an aliphatic group that may or may not be saturated, or a cycloalkyl or aromatic group, aryl, alkaryl or aralkyl group, comprising 1 to 12 carbon atoms.

By way of examples of the salts that can be used according to the invention, it is possible to cite N-butyl-pyridinium hexafluorophosphate, N-ethyl-pyridinium tetrafluoroborate, pyridinium fluorosulfonate, butyl-3-methyl-1-imidazolium tetrafluoroborate, butyl-3-methyl-1-imidazolium bis-trifluoromethane-sulfonyl amide, triethylsulfonium bis-trifluoromethane-sulfonyl amide, butyl-3-methyl-1-imidazolium hexafluoro-antimonate, butyl-3-methyl-1-imidazolium hexafluorophosphate, butyl-3-methyl-1-imidazolium trifluoroacetate, butyl-3-methyl-1-imidazolium trifluoromethylsulfonate, butyl-3-methyl-1-imidazolium bis(trifluoromethylsulfonyl)-amide, trimethyl-phenylammonium hexafluorophosphate, and tetrabutylphosphonium tetrafluoroborate. These salts can be used alone or in a mixture.

According to this invention, the alkylating agent has for its general formula RX, in which R represents a hydrocarbyl radical that has 1 to 12 carbon atoms, for example an aliphatic group that may or may not be saturated, a cycloalkyl or aromatic group, or an aryl, alkaryl or aralkyl group, comprising 1 to 12 carbon atoms, or hydrogen, or an oxonium group, and X represents an anion.

The $X^-$ anions can be identical or different from the $A^-$ anion that is present in the ionic liquid. The $X^-$ anions are preferably selected from among the halide anions, nitrate, sulfate, phosphate, acetate, haloacetates, tetrafluoroborate, tetrachloroborate, hexafluorophosphate, hexafluoroantimonate, fluorosulfonate, alkyl sulfonates (for example, methyl sulfonate), perfluoroalkyl sulfonates (for example, trifluoromethyl sulfonate), bis(perfluoroalkylsulfonyl) amides (for example, bis-trifluoromethane-sulfonyl amide of formula $N(CF_3SO_2)_2^-$), the tris-trifluoromethane-sulfononyl methylide of formula $C(CF_3SO_2)_3^-$, and arenesulfonates, optionally substituted by halogen or haloalkyl groups.

By way of alkylating agent examples, it is possible to cite methyl iodide, butyl iodide, benzyl chloride, tetrafluoroborate triethyloxonium, methyl trifluoroacetate, methyl trifluoroacetate, dimethyl sulfate, methyl sulfonate and triethylphosphate.

The hydrocarbon mixture that comprises the sulfur-containing derivatives and, if necessary, the nitrogen-containing derivatives and the ionic liquid that contains the alkylating agent can be brought into contact continuously or in a fractionated manner.

Advantageously, the mixture of hydrocarbons and the ionic liquid are brought into contact while being stirred.

The separation of ionic liquid from the hydrocarbon-containing mixture that is low in sulfur and, if necessary, low in nitrogen, can be carried out continuously, semi-continuously or intermittently.

The hydrocarbon-containing mixture according to the invention is preferably a middle distillate or an FCC gasoline fraction.

The sulfur-containing derivatives that are preferably eliminated are the mercaptans, the (alkyl)thiophenic compounds, (alkyl)benzothiophenic compounds and (alkyl) dibenzothiophenic compounds.

The nitrogen-containing derivatives that are preferably eliminated are the aromatic nitrogen-containing derivatives.

The process of desulfurization and denitrification can also be carried out before or after a deep catalytic desulfurization stage.

In the process of the invention, the ionic liquid that contains the sulfur-containing derivatives and, if necessary, the nitrogen-containing derivatives, can be regenerated.

The following examples illustrate the invention without limiting it.

EXAMPLES

In these examples, it was decided to work on model feedstocks that are representative of the gasolines. For this purpose, n-heptane was mixed with a sulfur-containing compound such as those that are present in gasolines. Three types of sulfur-containing compounds have been studied:

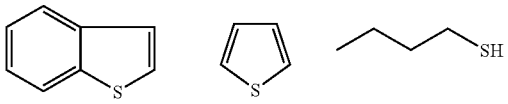

Benzothiophene thiophene n-butanethiol

The preparation of these feedstocks made it possible to carry out a gas-phase chromatography calibration. The latter was established by internal calibration by adding to the n-octane feedstocks (1% per unit of mass). For the desulfurization tests, it was decided to work on feedstocks that have a content of 1000 ppm of sulfur: they are well representative of a gasoline, this content also making it possible to quantify the desulfurization by GC analysis.

The extraction tests are carried out in a small glass reactor with a double jacket that is equipped with an argon intake that makes it possible to keep it under an inert atmosphere. The temperature is regulated by a coolant that circulates in the double jacket.

The ionic liquids were synthesized in the laboratory according to the operating procedures that are conventionally described in the literature. The alkylation agents that are used are commercial products that are used as such, without treatment.

Example 1

Extraction of Butanethiol in the [BMI][$NTF_2$] in the Presence of Methyl Triflate at 25° C.

In a double-jacket glass reactor that is equipped with a magnetic stirring mechanism, 2.5 ml of butyl-1-methyl-3-imidazolium bistrifluoromethylsulfonylamide [BMI][$NTF_2$] and 10 equivalents (0.25 ml, 363 mg) of methyl triflate (calculated relative to butanethiol that is present in the feedstock) are introduced simultaneously under an inert atmosphere. In the absence of stirring, 10 ml of a heptane feedstock that contains butane thiol $CH_3(CH_2)_3SH$ (feedstock with 1000 ppm of sulfur) and 1% of n-octane (internal standard) are added. The reaction mixture then comes in the form of a two-phase system. The stirring is then started (1000 rpm). The temperature of the system is kept at 25° C. by circulation of a fluid in the double jacket of the reactor. At regular intervals, 0.8 ml samples of the organic phase (upper phase) are taken that are then analyzed by GC to determine the sulfur content. After only 420 minutes of reaction, the butanethiol is no longer detected in the organic phase (<10 ppm of S). It can be considered that 100% of the butanethiol that was initially present was extracted in the ionic liquid phase.

Example 2

Extraction of Butanethiol in the [BMI][$NTF_2$] in the Presence of Methyl Triflate at 50° C.

The operating procedure that is followed is identical in all respects to that of Example 1, except that the temperature is brought to 50° C. After only 180 minutes of stirring, the butanethiol is no longer detected in the organic phase (<10 ppm of S). It can be considered that 100% of the butanethiol that was initially present was extracted in the ionic liquid phase.

Example 3

Extraction of Butanethiol in the [BMI][$NTF_2$] in the Presence of Tetrafluoroborate Trimethyloxonium at 25° C.

In a double-jacket glass reactor that is equipped with a magnetic stirring mechanism, 2.5 ml of butyl-1-methyl-3-imidazolium bistrifluoromethylsulfonylamide [BMI][$NTF_2$] and 10 equivalents (315 mg) of trimethyloxonium tetrafluoroborate (calculated relative to the butanethiol that is present in the feedstock) are introduced simultaneously under an inert atmosphere. In the absence of stirring, 10 ml of a heptane feedstock that contains butanethiol $CH_3(CH_2)_3SH$ (feedstock with 1000 ppm of sulfur) and 1% of n-octane (internal standard) are added. The reaction mixture then comes in the form of a two-phase system. The stirring is then started (1000 rpm). The temperature of the system is kept at 25° C. by circulation of a fluid in the double jacket of the reactor. At regular intervals, 0.8 ml samples of the organic phase (upper phase) are taken that are then analyzed by GC to determine the sulfur content. After only 30 minutes of reaction, 90.2% of the butanethiol that was initially present was extracted in the ionic liquid phase.

Example 4

Extraction of Butanethiol in the [BMI][$NTF_2$] in the Presence of Trimethyloxonium Tetrafluoroborate at 50° C.

The operating procedure that is followed is identical in all respects to that of Example 3, except that the temperature is brought to 50° C. After only 30 minutes of stirring, the butanethiol is no longer detected in the organic phase (<10 ppm of S). It can be considered that 100% of the butanethiol that was initially present was extracted in the ionic liquid phase.

Example 5

Counter-Example

The operating procedure that is followed is identical in all respects to that of Example 1, except that the addition of methyl triflate (alkylating agent) is not carried out. The liquid/liquid absorption equilibrium is reached very quickly. After 5 minutes of stirring at 25° C., it appears that only 7.7% of sulfur was extracted in the ionic liquid phase. This value no longer changes even after 2 hours of vigorous stirring.

Example 6

Extraction of Butanethiol in [BuMePyrr][$NTF_2$] in the Presence of Methyl Triflate at 25° C.

The operating procedure that is followed is identical in all respects to that of Example 1, except that the [BMI][$NTF_2$]

is replaced by N-butyl-N-methylpyrrolidinium bis(trifluoromethylsulfonyl)amide, represented by the formula [BuMePyrr][$NTF_2$]. After 420 minutes of stirring, the butanethiol is no longer detected in the organic phase (<10 ppm of S). It can be considered that 100% of the butanethiol that was initially present was extracted in the ionic liquid phase.

Example 7

Extraction of Butanethiol in [BuMePyrr][$NTF_2$] in the Presence of methyl Triflate at 50° C.

The operating procedure that is followed is identical in all respects to that of Example 6, except that the temperature is brought to 50° C. After only 180 minutes of stirring, the butanethiol is no longer detected in the organic phase (<10 ppm of S). It can be considered that 100% of the butanethiol that was initially present was extracted in the ionic liquid phase.

Example 8

Counter-Example

The operating procedure that is followed is identical in all respects to that of Example 6, except that the addition of methyl triflate (alkylating agent) is not carried out. The liquid/liquid absorption equilibrium is reached very quickly. After 5 minutes of stirring at 25° C., it appears that only 4.9% of sulfur was extracted in the ionic liquid phase. This value no longer changes even after 2 hours of vigorous stirring.

The preceding examples can be repeated with similar success by substituting the generically or specifically described reactants and/or operating conditions of this invention for those used in the preceding examples.

The entire disclosures of all applications, patents and publications, cited herein and of corresponding French application No. 02/07.453, filed Jun. 17, 2002 are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for eliminating sulfur-containing compounds from a mixture of hydrocarbons comprising said compounds, said process comprising:

contacting said hydrocarbon mixture with a non-aqueous ionic liquid of general formula $Q^+A^-$ that contains at least one alkylating agent, to form ionic sulfur-containing derivatives soluble in the ionic liquid; and separating said ionic liquid from the resultant hydrocarbon mixture depleted in sulfur, wherein $Q^+$ is a cation selected from at least one of a phosphonium, ammonium, sulfonium cation, and mixtures thereof, and the alkylating agent is of the formula RX, in which R represents a hydrocarbyl radical that has 1 to 12 carbon atoms and X represents an anion.

2. A process according to claim 1, wherein in the non-aqueous ionic liquid of formula $Q^+A^-$, the $A^-$ anions are selected from the group consisting of the halide anions, nitrate, sulfate, phosphate, acetate, haloacetates, tetrafluoroborate, tetrachloroborate, hexafluorophosphate, hexafluoroantimonate, fluorosulfonate, alkyl sulfonates, perfluoroalkyl sulfonates, bis(perfluoroalkylsulfonyl) amides, tris-trifluoromethanesulfononyl methylide of formula $C(CF_3SO_2)_3^-$, unsubstituted arenesulfonates, arenesulfonates substituted by halogen or haloalkyl groups, as well as the tetraphenylborate anion and the tetraphenylborate anions whose aromatic cores are substituted.

3. A process according to claim 1, wherein the ammonium and/or phosphonium $Q^+$ cation corresponds to one of general formulas $NR^1R^2R^3R^{4+}$ and $PR^1R^2R^3R^{4+}$ or to one of general formulas $R^1R^2N{=}CR^3R^{4+}$ and $R^1R^2P{=}CR^3R^{4+}$ in which $R^1$, $R^2$, $R^3$ and $R^4$, identical or different, each represent hydrogen, or a hydrocarbyl radical that has 1 to 30 carbon atoms.

4. A process according to claim 3, wherein in the general formulas $NR^1R^2R^3R^{4+}$, $PR^1R^2R^3R^{4+}$, $R^1R^2N{=}CR^3R^{4+}$ and $R^1R^2P{=}CR^3R^{4+}$, at most one of substituents $R^1$, $R^2$, $R^3$ and $R^4$ represents hydrogen.

5. A process according to claim 3, wherein $R^1$, $R^2$, $R^3$ and $R^4$ each represent an aliphatic group, a cycloalkyl or aromatic group, or an aryl or aralkyl group, optionally substituted.

6. A process according to claim 1, wherein the ammonium and/or phosphonium cation is derived from a nitrogen-containing and/or phosphorus-containing heterocyclic compound that comprises 1, 2 or 3 nitrogen atoms and/or phosphorus atoms, corresponding to one of general formulas:

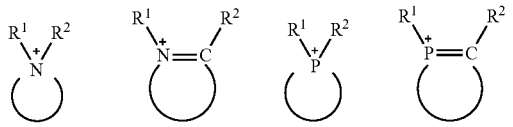

in which the rings comprise 4 to 10 cyclic atoms, and $R^1$ and $R^2$ are identical or different and represent hydrogen or a hydrocarbyl group of 1–30 carbon atoms.

7. A process according to claim 1, wherein the ammonium or phosphonium cation corresponds to one of the general formulas: $R^1R^{2+}N{=}CR^3{-}R^5{-}R^3C{=}N^+R^1R^2$ and $R^1R^{2+}P{=}CR^3{-}R^5{-}R^3C{=}P^+R^1R^2$ in which $R^1$, $R^2$ and $R^3$, identical or different, each represents hydrogen or hydrocarbyl of 1–30 carbon atoms and $R^5$ represents an alkylene radical or a phenylene radical.

8. A process according to claim 5, wherein the groups $R^1$, $R^2$, $R^3$ and $R^4$ each represent methyl, ethyl, propyl, isopropyl, butyl, sec-butyl, tert-butyl, amyl, phenyl or benzyl.

9. A process according to claim 1, wherein $Q^+$ represents an ammonium and/or phosphonium cation selected from the group consisting of N-butylpyridinium, N-ethylpyridinium, pyridinium, ethyl-3-methyl-1-imidazolium, butyl-3-methyl-1-imidazolium, hexyl-3-methyl-1-imidazolium, butyl-3-dimethyl-1,2-imidazolium, diethyl-pyrazolium, N-butyl-N-methylpyrrolidinium, trimethylphenyl-ammonium, tetrabutylphosphonium, and tributyl-tetradecyl-phosphonium.

10. A process according to claim 1, wherein $Q^+$ is the sulfonium cation of the formula $SR^1R^2R^{3+}$, where $R^1$, $R^2$ and $R^3$, identical or different, each represent a hydrocarbyl radical that has 1 to 12 carbon atoms.

11. A process according to claim 10, wherein $R^1$, $R^2$ and $R^3$ each represent an aliphatic group, a cycloalkyl or aromatic group or an aryl, alkaryl or aralkyl group.

12. A process according to claim 1, wherein the non-aqueous ionic liquid is N-butyl-pyridinium hexafluorophosphate, N-ethyl-pyridinium tetrafluoroborate, pyridinium fluorosulfonate, butyl-3-methyl-1-imidazolium tetrafluoroborate, butyl-3-methyl-1-imidazolium bis-trifluoromethane-sulfonyl amide, triethylsulfonium bis-trifluoromethane-sulfonyl amide, butyl-3-methyl-1-imidazolium hexafluoro-antimonate, butyl-3-methyl-1-imidazolium hexafluorophosphate, butyl-3-methyl-1-imidazolium trifluoroacetate, butyl-3-methyl-1-imidazolium trifluoromethylsulfonate, butyl-3-methyl-1-imidazolium bis(trifluoromethylsulfonyl)-amide, trimethyl-phenylammonium hexafluoro-phosphate, or tetrabutylphosphonium tetrafluoroborate.

13. A process according to claim 1, wherein R represents an aliphatic group that may or may not be saturated, a cycloalkyl or aromatic group, or an aryl, alkaryl or aralkyl group that comprises 1 to 12 carbon atoms, or hydrogen, or an oxonium group.

14. A process according to claim 1, wherein the $X^-$ anion of the alkylating agent, identical to or different from the $A^-$ anion of the ionic liquid, is selected from among the halide anions, nitrate, sulfate, phosphate, acetate, haloacetates, tetrafluoroborate, tetrachloroborate, hexafluorophosphate, hexafluoroantimonate, fluorosulfonate, alkyl sulfonates, perfluoroalkyl sulfonates, bis(perfluoroalkylsulfonyl) amides, tris-trifluoromethanesulfononyl methylide of formula $C(CF_3SO_2)_3^-$, the arenesulfonates, and the arenesulfonates that are substituted by halogen or haloalkyl groups.

15. A process according to claim 1, wherein the alkylating agent is methyl iodide, butyl iodide, benzyl chloride, triethyloxonium, dimethyl sulfate, methyl sulfonate or triethylphosphate.

16. A process according to claim 1, wherein the hydrocarbon mixture contains, at least one of mercaptans, (alkyl) thiophenic compounds, (alkyl)benzothiophenic compounds and (alkyl)dibenzothiophenic compounds.

17. A process for eliminating sulfur-containing compounds from a mixture of hydrocarbons comprising said compounds, said process comprising:

contacting said hydrocarbon mixture with a non-aqueous ionic liquid of general formula $Q^+A^-$ that contains at least one alkylating agent, to form ionic sulfur-containing derivatives soluble in the ionic liquid; and separating said ionic liquid from the resultant hydrocarbon mixture depleted in sulfur, wherein $Q^+$ is a cation selected from at least one of a phosphonium, ammonium, sulfonium cation, and mixtures thereof, and the alkylating agent is of the formula RX, in which R represents a hydrocarbyl radical that has 1 to 12 carbon atoms and X represents an anion, and wherein the mixture of hydrocarbons further contains nitrogen-containing derivatives and said derivatives are converted to ionic nitrogen-containing derivatives soluble in the ionic liquid.

18. A process for eliminating sulfur-containing compounds from a mixture of hydrocarbons comprising said compounds wherein the hydrocarbon mixture contains, at least one of mercaptans, (alkyl)thiophenic compounds, (alkyl)benzothiophenic compounds and (alkyl)dibenzothiophenic compounds, said process comprising:

contacting said hydrocarbon mixture with a non-aqueous ionic liquid of general formula $Q^+A^-$ that contains at least one alkylating agent, to form ionic sulfur-containing derivatives soluble in the ionic liquid; and separating said ionic liquid from the resultant hydrocarbon mixture depleted in sulfur wherein $Q^+$ is a cation selected from at least one of a phosphonium, ammonium, sulfonium cation, and mixtures thereof, and the alkylating agent is of the formula RX, in which R represents a hydrocarbyl radical that has 1 to 12 carbon atoms and X represents an anion, and wherein the mixture of hydrocarbons further contains nitrogen-containing derivatives and said derivatives are converted to ionic nitrogen-containing derivatives soluble in the ionic liquid.

19. A process according to claim 18, further comprising regenerating the ionic liquid that contains the sulfur-containing and nitrogen-containing derivatives.

20. A process according to claim 18, wherein the nitrogen-containing derivatives are selected from the group consisting of pyridines, amines, pyrroles, anilines, quinoline, acridine, optionally substituted by alkyl, aryl or alkaryl groups and mixtures thereof.

21. A process according to claim 1, further comprising either upstream or downstream of said contacting the hydrocarbon mixture with said non-aqueous ionic liquid, conducting a hydrodesulfurization of said hydrocarbon mixture with a sulfide type catalyst.

22. A process according to claim 1, wherein said separating comprises decanting.

* * * * *